US008370134B2

(12) United States Patent
Briand et al.

(10) Patent No.: US 8,370,134 B2
(45) Date of Patent: Feb. 5, 2013

(54) DEVICE AND METHOD FOR ENCODING BY PRINCIPAL COMPONENT ANALYSIS A MULTICHANNEL AUDIO SIGNAL

(75) Inventors: Manuel Briand, Djursholm (SE); David Virette, Pleumer Bodou (FR)

(73) Assignee: France Telecom, Paris (FR)

( * ) Notice: Subject to any disclaimer, the term of this patent is extended or adjusted under 35 U.S.C. 154(b) by 1144 days.

(21) Appl. No.: 12/293,041

(22) PCT Filed: Mar. 8, 2007

(86) PCT No.: PCT/FR2007/050896

§ 371 (c)(1),
(2), (4) Date: Sep. 15, 2008

(87) PCT Pub. No.: WO2007/104882

PCT Pub. Date: Sep. 20, 2007

(65) Prior Publication Data

US 2009/0083044 A1 Mar. 26, 2009

(30) Foreign Application Priority Data

Mar. 15, 2006 (FR) ..... 06 50882

(51) Int. Cl.
*G10L 19/14* (2006.01)

(52) U.S. Cl. ..... 704/205; 381/23; 381/22

(58) Field of Classification Search ..... 381/23; 704/E19.005, 500, 205
See application file for complete search history.

(56) References Cited

U.S. PATENT DOCUMENTS 6,016,473 A * 1/2000 Dolby ..... 704/500
6,292,830 B1 * 9/2001 Taylor et al. ..... 709/224
7,725,324 B2 * 5/2010 Bruhn et al. ..... 704/500
7,751,572 B2 * 7/2010 Villemoes et al. ..... 381/23
2003/0198357 A1 * 10/2003 Schneider et al. ..... 381/94.2
2004/0076301 A1 * 4/2004 Algazi et al. ..... 381/17
2009/0316914 A1 * 12/2009 Henn et al. ..... 381/23

FOREIGN PATENT DOCUMENTS

WO WO 03/085645 10/2003
WO WO 2006/000952 1/2006

OTHER PUBLICATIONS

M. Briand et al., "Parametric representation of multichannel audio based on principal component analysis", 120$^{th}$ AES, p. 6813, Jun. 20, 2006, XP008069356.

* cited by examiner

*Primary Examiner* — Jakieda Jackson
(74) *Attorney, Agent, or Firm* — Cozen O'Connor

(57) ABSTRACT

A system and a method for coding by principal component analysis (PCA) of a multi-channel audio signal comprising the following steps: decomposing at least two channels (L, R) of said audio signal into a plurality of frequency sub-bands ($I(b_1), \ldots, I(b_N), r(b_1), \ldots, r(b_N)$), calculating at least one transformation parameter ($\theta(b_1), \ldots, \theta(b_N)$) as a function of at least some of said plurality of frequency sub-bands, transforming at least some of said plurality of frequency sub-bands into a plurality of frequency sub-components as a function of said at least one transformation parameter ($\theta(b_1), \ldots, \theta(b_N)$), said plurality of frequency sub-components comprising principal frequency sub-components ($CP(b_1), \ldots, CP(b_N)$), combining at least some of said principal frequency sub-components ($CP(b_1), \ldots, CP(b_N)$) in order to form a principal component (CP), and defining a coded audio signal (SC) representing said multi-channel audio signal ($C_1, \ldots, C_M$), said coded audio signal (SC) comprising said principal component (CP) and said at least one transformation parameter ($\theta(b_1), \ldots, \theta(b_N)$).

24 Claims, 16 Drawing Sheets

DEVICE AND METHOD FOR ENCODING BY PRINCIPAL COMPONENT ANALYSIS A MULTICHANNEL AUDIO SIGNAL

RELATED APPLICATIONS

This is a U.S. national stage under 35 USC 371 of application No. PCT/FR2007/050896, filed on Mar. 8, 2007.

This application claims the priority of French patent application no. 06/50882 filed Mar. 15, 2006, the content of which is hereby incorporated by reference.

FIELD OF THE INVENTION

The invention relates to the field of coding by principal component analysis of a multi-channel audio signal for audio-digital transmissions over various transmission networks at various data rates. More particularly, the aim of the invention is to allow low-data-rate transmission of multi-channel audio signals of the stereophonic (2 channels) or 5.1 (6 channels) type or others.

BACKGROUND OF THE INVENTION

In the framework of the coding of multi-channel audio signals, two approaches are particularly well known and used.

The first and oldest consists in matrixing the channels of the original multi-channel signal in such a manner as to reduce the number of signals to be transmitted. By way of example, the Dolby® Pro Logic® II multi-channel audio coding method carries out the matrixing of the six channels of a 5.1 signal into two signals to be transmitted. Several types of decoding can be applied in order to reconstruct as faithfully as possible the six original channels.

The second approach, called parametric audio coding, is based on the extraction of spatialization parameters in order to reconstruct the spatial perception of the listener. This approach is mainly based on a method called "Binaural Cue Coding" (BCC) which aims, on the one hand, to extract then to code the indices of the hearing localization and, on the other hand, to code a monophonic or stereophonic signal coming from the matrixing of the original multi-channel signal.

In addition, there is one approach, hybrid of the two above approaches, based on a method called "Principal Component Analysis" (PCA). Indeed, PCA can be seen as a dynamic matrixing of the channels of the multi-channel signal to be coded. More precisely, the PCA is obtained by rotation of the data whose angle corresponds to the spatial position of the dominant sound sources, at least for the stereophonic case. This transformation is furthermore considered as the optimal decorrelation method that allows the energy of the components of a multi-component signal to be compacted. One example of stereophonic audio coding using PCA is disclosed in the documents WO 03/085643 and WO 03/085645.

However, the PCA carried out according to the prior art does not allow a precise characterization of the signals to be coded and, consequently, the energy of the signals coming from this analysis is not compacted enough in the principal component.

SUMMARY OF THE INVENTION

One aspect of the present invention relates to a method for coding by principal component analysis (PCA) of a multi-channel audio signal. This method comprises the following steps:

- decompose at least two channels of the audio signal into a plurality of frequency sub-bands;
- calculate at least one transformation parameter as a function of at least some of the plurality of frequency sub-bands;
- transform at least some of the plurality of frequency sub-bands into a plurality of frequency sub-components as a function of said at least one transformation parameter, the plurality of frequency sub-components comprising principal frequency sub-components;
- combine at least some of the principal frequency sub-components in order to form a principal component; and
- define a coded audio signal representing the multi-channel audio signal, the coded audio signal comprising the principal component and said at least one transformation parameter.

The principal component analysis according to an embodiment of the invention is an analysis in the frequency domain using frequency sub-bands which can be established according to a scale equivalent to that of the critical bands of the hearing and allows a more precise characterization to be obtained for the signals to be coded. Consequently, the energy of the signals coming from the principal component analysis PCA carried out by frequency sub-bands is further compacted in the principal component compared with the energy of the signals coming from a PCA carried out in the time domain.

Accordingly, the coded audio signal, which is a well-compacted signal of the original multi-channel audio signal, can be transmitted over a low-data-rate transmission network irrespective of the number of channels in the original signal while at the same time allowing the reconstruction of a high quality audio signal, perceptually quite close to the original audio signal.

According to one feature of the invention, the plurality of frequency sub-components also comprises residual frequency sub-components.

The residual frequency sub-components are representative of the decorrelated secondary and background sound sources and may be used to better reproduce the background sound.

According to another feature of the invention, the coding method according to the invention comprises the formation/extraction of a set of energy parameters by frequency sub-bands as a function of the residual frequency sub-components.

According to another feature of the invention, the set of energy parameters is formed by extraction of the energy differences by frequency sub-bands between the principal frequency sub-components and the residual frequency sub-components.

According to another feature of the invention, the set of energy parameters corresponds to the energies by frequency sub-bands of the residual frequency sub-components.

The extraction of the energy differences or energies by frequency sub-bands of the residual sub-components allows band by band transmission of the energy corresponding to the background sound.

According to another feature of the invention, the coding method comprises a filtering of the principal frequency sub-components before the extraction of the set of energy parameters.

This allows any potential modification in amplitude to be compensated in the case where the filtering also used in the decoding modifies the amplitude of the signals.

According to another feature of the invention, the coded audio signal also comprises at least one energy parameter from amongst the set of energy parameters.

Thus, the background sound can easily be synthesized starting from the principal component and from the energy parameter included in the coded audio signal, further improving the perception of the original audio signal.

According to another feature of the invention, the coding method comprises a combination of at least some of the residual frequency sub-components in order to form at least one residual component, the coded audio signal also comprising said at least one residual component.

This is one variant that also allows the background sound, in other words the original signal, to be reconstituted as faithfully as possible from the coded audio signal.

According to another feature of the invention, the coding method comprises a correlation analysis between said at least two channels in order to determine a corresponding correlation value, the coded audio signal also comprising this correlation value.

Thus, the correlation value can indicate the possible presence of reverberation in the original signal allowing the quality of the decoding of the coded signal to be improved.

According to another feature of the invention, the plurality of frequency sub-bands is defined according to a perceptual scale.

Thus, the coding method takes the frequency resolution of the human hearing system into account.

According to another feature of the invention, the definition of the coded audio signal comprises an audio coding of the principal component and a quantification of said at least one transformation parameter and/or a quantification of said at least one energy parameter, and/or a quantification of said at least one residual component.

Thus, the coded audio signal can easily be transmitted over various transmission networks at various data rates.

It will be noted that, in the case of the coding of more than two channels, it would then be possible to code the (at least) two principal components with a stereo coder or other.

According to another feature of the invention, the audio signal is defined by a succession of frames such that said at least two channels are defined for each frame.

This allows the precision of the principal component analysis to be increased and consequently the quality of the coded signal to be improved.

According to another feature of the invention, the multichannel audio signal is a stereophonic signal.

According to another feature of the invention, the multichannel audio signal is an audio signal in the 5.1 format comprising the following channels: Left, Center, Right, Left surround, Right surround, and Low Frequency Effect.

According to another feature of the invention, the coding method comprises the formation of a first triplet of signals comprising the Left, Center, and Left surround channels and of a second triplet of signals comprising the Right, Center, and Right surround channels, the first and second triplets being used separately in order to form first and second principal components depending on transformation parameters comprising first and second Euler angles, respectively.

Another aspect of the invention is directed to a method for decoding a received signal comprising a coded audio signal constructed according to the coding method described hereinbefore. This decoding method comprises the following steps:

receive the coded audio signal;

extract a decoded principal component and at least one decoded transformation parameter;

decompose the decoded principal component into decoded principal frequency sub-components;

transform the decoded principal frequency sub-components into a plurality of decoded frequency sub-bands; and combine the decoded frequency sub-bands in order to form at least two decoded channels corresponding to said at least two channels coming from the original multi-channel audio signal.

According to one feature of the invention, the decoding method comprises the inverse quantification of the energy parameters included in the coded audio signal in order to synthesize decoded residual frequency sub-components.

According to another feature of the invention, the decoding method comprises a step for decorrelation of the decoded residual frequency sub-components in order to form decorrelated residual sub-components.

According to another feature of the invention, the decorrelation of the decoding method according to the invention is carried out by a decorrelation or reverberation filtering according to the correlation value included in the coded audio signal.

Another aspect of the invention is directed to an encoder using principal component analysis (PCA) of a multi-channel audio signal, comprising:

decomposition means for decomposing at least two channels of the audio signal into a plurality of frequency sub-bands, calculation means for calculating at least one transformation parameter as a function of at least some of the plurality of frequency sub-bands, transformation means for transforming at least some of the plurality of frequency sub-bands into a plurality of frequency sub-components as a function of said at least one transformation parameter, the plurality of frequency sub-components comprising principal frequency sub-components, combination means for combining at least some of the principal frequency sub-components in order to form a principal component, and definition means for defining a coded audio signal representing the multi-channel audio signal, the coded audio signal comprising the principal component and said at least one transformation parameter.

Another subject of the invention is a decoder of a received signal comprising a coded audio signal coming from an original multi-channel signal comprising at least two channels. This decoder comprises:

extraction means for extracting a decoded principal component and at least one decoded transformation parameter, decoding decomposition means for decomposing the decoded principal component into decoded principal frequency sub-components, inverse transformation means for transforming the decoded principal frequency sub-components into a plurality of decoded frequency sub-bands, and decoding combination means for combining the decoded frequency sub-bands in order to form at least two decoded channels corresponding to said at least two channels coming from the original multi-channel audio signal.

Another subject of the invention is a system comprising the encoder and the decoder, such as are described hereinabove.

As a variant, the various steps of the coding and decoding methods described hereinabove are determined by computer program instructions.

Consequently, another aspect of the invention is a computer program comprising instructions for the execution of the steps of the coding and/or decoding methods described hereinabove when said program is executed by a computer.

This program may use any programming language, and may be in the form of source code, object code, or of code intermediate between source code and object code, such as in a partially compiled form, or in any other form that may be desired.

Another aspect of the invention is a recording medium readable by a computer on which a computer program is recorded that comprises instructions for the execution of the steps of the coding and/or decoding methods described hereinbefore.

The information medium may be any entity or device capable of storing the program. For example, the medium can comprise a storage means, such as an ROM, for example a CD ROM or a microelectronic circuit ROM, or alternatively a magnetic recording means, for example a floppy disk or a hard disk.

Furthermore, the information medium may be a transmissible medium such as an electrical or optical signal, which can be carried via an electrical or optical cable, by radio or by other means. The program according to the invention may, in particular, be uploaded to and downloaded from a network of the Internet type.

Alternatively, the information medium may be an integrated circuit into which the program is incorporated, the circuit being designed to execute or to be used in the execution of the methods in question.

Thus, an embodiment of the present invention uses a method for coding the signals coming from the PCA that is better adapted to the characteristics of the signals than that described in the documents of the prior art WO 03/085643 and WO 03/085645. Indeed, the method described in these documents uses linear prediction of the signals coming from the PCA. However, linear prediction is a method suited to the coding of correlated signals which produces an error signal, relating to the difference of the processed signals, with low energy. Consequently, the linear prediction, used in these documents, applied to the decorrelated signals coming from the PCA is not well adapted.

For this reason, an embodiment of the present invention is directed to a method for coding the signals coming from the PCA based on a frequency analysis by frequency sub-band which allows the extraction of the energy differences between the components coming from the PCA or the transmission (after quantification) of the energy, band by band, of the background sound component.

It should be pointed out that the PCA, carried out by frequency sub-band, delivers band-limited components starting from which the frequency analysis by frequency sub-band is immediate. Thus, the decoder can generate the low-energy component coming from the PCA using the coded and transmitted principal energy component, and quantified and transmitted energy parameters.

In a manner so as to obtain components decorrelated from one another, the decoder uses, by default, an all-pass filter known as a decorrelation filter. Whereas a reverberation filter is used in the documents WO 03/085643 and WO 03/085645, the present invention proposes a switching between a decorrelation filter and a reverberation filter only when the analysis of the signals carried out at the encoding has detected the presence of reverberation in the original signals. Indeed, only an index is calculated at the encoder and transmitted for each frame processed so as to inform the decoder of the type of filter to be used. This switching between the filters to be used then allows reverberation of the signals, which are not originally reverberating, to be avoided and therefore the audio quality of the decoded signals to be improved.

Lastly, an aspect of the present invention is directed to a coding method adapted to the coding of signals of the 5.1 type which constitutes an extension of the coding method for stereophonic signals based on PCA in sub-bands. For this purpose, a three-dimensional PCA is implemented and its parameters set by Euler angles. This extension can also serve as a basis for the parametric audio coding of sound scenes enhanced in terms of the number of channels (for example, for the formats 6.1, 7.1, ambisonic, etc.).

BRIEF DESCRIPTION OF THE DRAWINGS

Other features and advantages of the invention will become apparent upon reading the description presented, hereinafter, by way of nonlimiting example, with reference to the appended drawings, in which.

DETAILED DESCRIPTION OF EMBODIMENTS

Figure 1:
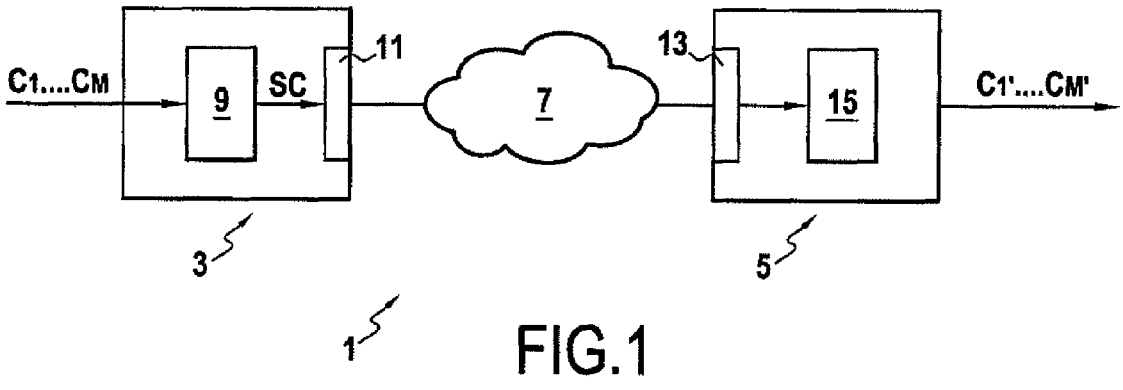
FIG. 1 is a schematic view of a communications system comprising a coding device and a decoding device according to an embodiment of the invention.

According to the invention, FIG. 1 is a schematic view of a communications system 1 comprising a coding device 3 and a decoding device 5. The coding 3 and decoding 5 devices can be connected together by means of a communications network or line 7.

The coding device 3 comprises an encoder 9 which, upon receiving a multi-channel audio signal $C_1, \ldots, C_M$ generates a coded audio signal SC representative of the original multi-channel audio signal $C_1, \ldots, C_M$.

The encoder 9 can be connected to a means of transmission 11 in order to transmit the coded signal SC via the communications network 7 to the decoding device 5.

The decoding device 5 comprises a receiver 13 for receiving the coded signal SC transmitted by the coding device 3. In addition, the decoding device 5 comprises a decoder 15 which, upon receiving the coded signal SC, generates a decoded audio signal $C'_1, \ldots, C'_M$ corresponding to the original multi-channel audio signal $C_1, \ldots, C_M$.

Figure 2:
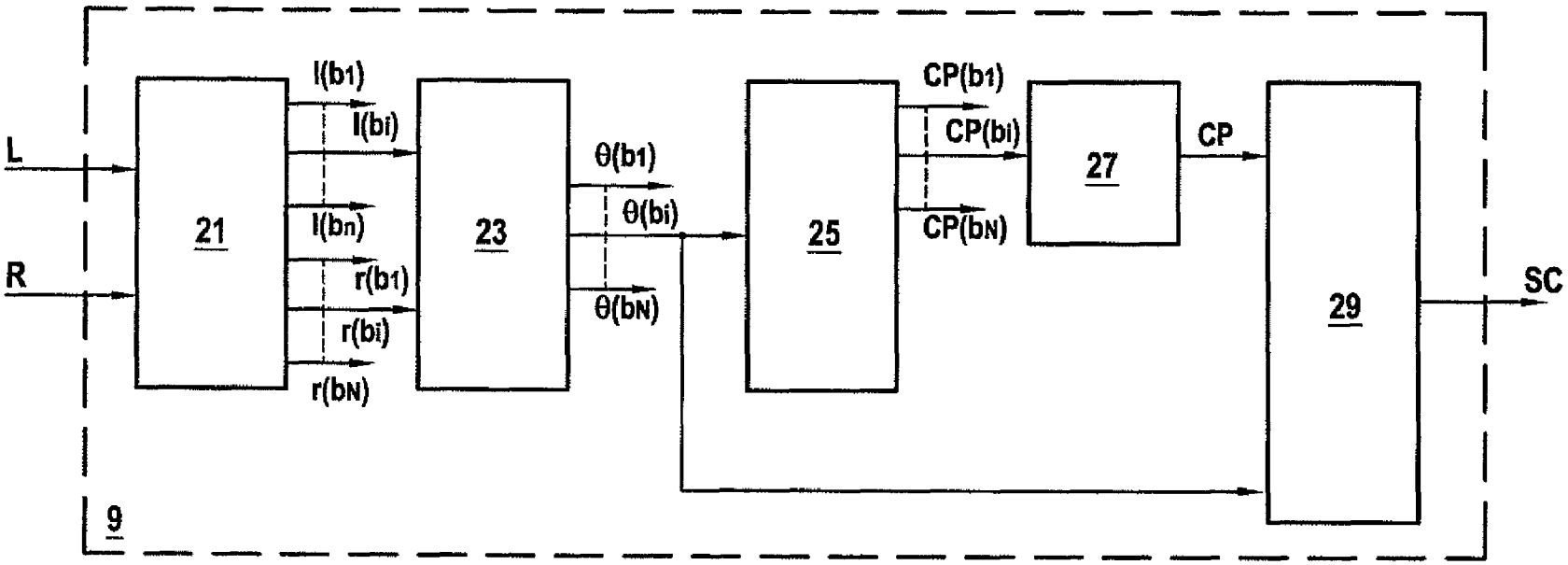
FIG. 2 is a schematic view of an encoder according to an embodiment of the invention.

FIG. 2 is a schematic view of the encoder 9 comprising decomposition means 21, calculation means 23, transformation means 25, combination means 27 and definition means 29.

FIG. 2 is also an illustration of the main steps of the coding method according to the invention.

The decomposition means 21 are designed to decompose at least two channels L and R of the multi-channel audio signal $C_1, \ldots, C_M$ into a plurality of frequency sub-bands $I(b_1), \ldots, I(b_N), r(b_1), \ldots, r(b_N)$.

Advantageously, the plurality of frequency sub-bands $I(b_1), \ldots, I(b_N), r(b_1), \ldots, r(b_N)$ is defined according to a perceptual scale.

Furthermore, the decomposition of the two channels L and R can be carried out by firstly transforming each time channel L or R into a frequency channel thus forming two frequency components. By way of example, the formation of these two frequency signals is carried out by application of a short-term Fourier transform (STFT) to the two channels L and R. Subsequently, the frequency coefficients of the frequency signals can be grouped into sub-bands ($b_1, \ldots, b_N$) in order to obtain the plurality of frequency sub-bands $I(b_1), \ldots, I(b_N)$, $r(b_1), \ldots, r(b_N)$.

The calculation means 23 are designed to calculate at least one transformation parameter $\theta(b_1)$ from amongst a plurality of transformation parameters $\theta(b_1), \ldots, \theta(b_N)$ as a function of at least some of the plurality of frequency sub-bands.

By way of example, the calculation of the transformation parameters can be carried out by calculating a covariance matrix for each frequency sub-band of the plurality of frequency sub-bands $I(b_1), \ldots, I(b_N)$, $r(b_1), \ldots, r(b_N)$. Thus, the covariance matrix allows the eigenvalues to be calculated for each frequency sub-band. Finally, these eigenvalues allow the transformation parameters $\theta(b_1), \ldots, \theta(b_N)$ to be calculated.

Thus, to each frequency sub-band $b_i$ can correspond a transformation parameter $\theta(b_i)$ defining an angle of rotation corresponding to the position of the dominant source of the frequency sub-band.

It will be noted that it is also possible to calculate the transformation parameters based only on a covariance of the two original channels L and R.

The transformation means 25 are designed to transform by PCA at least some of the plurality of frequency sub-bands $I(b_1), \ldots, I(b_N)$, $r(b_1), \ldots, r(b_N)$ into a plurality of frequency sub-components as a function of at least one transformation parameter $\theta(b_i)$. The plurality of frequency sub-components comprises principal frequency sub-components $CP(b_1), \ldots, CP(b_N)$.

Indeed, the transformation parameter $\theta(b_i)$ allows a rotation of the data by frequency sub-band to be performed which results in a principal component $CP(b_i)$ whose energy corresponds to the highest eigenvalue calculated for the sub-band $b_i$.

The combination means 27 are designed to combine at least some of the principal frequency sub-components $CP(b_1), \ldots, CP(b_N)$ in order to form one single principal component CP.

This can be carried out by summing the principal frequency sub-components $CP(b_1), \ldots, CP(b_N)$ in order to form a principal frequency component. Subsequently, an inverse short-term Fourier transform $(STF)^{-1}$ is applied to the principal frequency component in order to form a principal time component CP.

The definition means 29 are designed to define a coded audio signal SC representing the multi-channel audio signal $C_1, \ldots, C_M$. This coded audio signal SC comprises the principal component CP and at least one transformation parameter $\theta(b_i)$ from amongst the plurality of transformation parameters $\theta(b_1), \ldots, \theta(b_N)$.

Thus, a PCA by frequency sub-bands allows a more precise characterization to be obtained of the signals to be coded. Consequently, the energy of the signals coming from the PCA carried out by frequency sub-bands is further compacted in the principal component compared with the energy of the signals coming from a PCA carried out in the time domain.

It will be noted that the multi-channel audio signal can be defined by a succession of frames n, n+1, etc. such that the two channels L and R are defined for each frame n.

Figure 3:
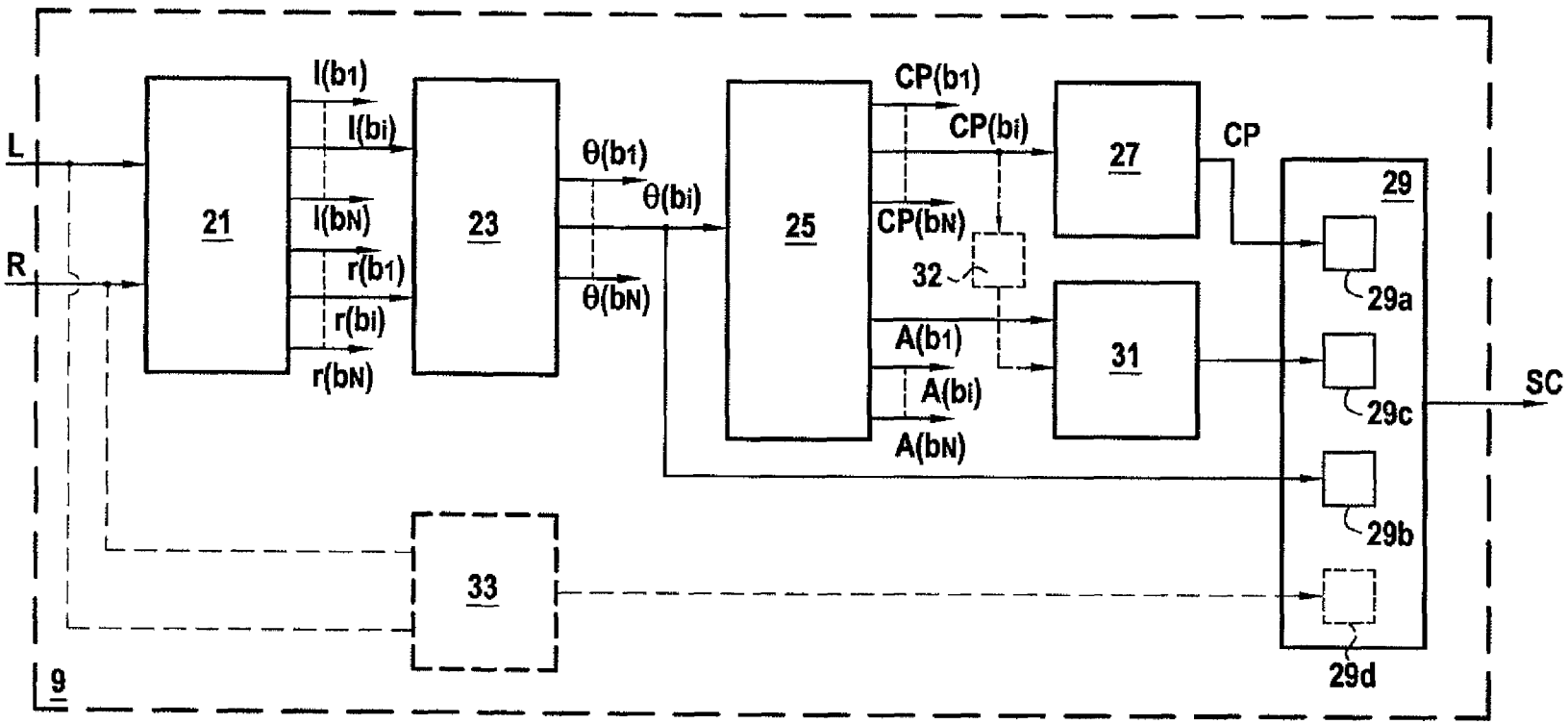
FIGS. 3 and 4 are variants of FIG. 2.

FIG. 3 is a variant of FIG. 2 showing that the plurality of frequency sub-components also comprises residual frequency sub-components $A(b_1), \ldots, A(b_N)$.

Indeed, for each frequency sub-band, the transformation parameter $\theta(b_i)$ allows a rotation of the data by frequency sub-band to be effected which results in a principal component $CP(b_i)$ and at least one residual component $A(b_i)$. The energy of a residual component $A(b_i)$ is also proportional to the eigenvalue associated with it. It will be noted that the eigenvalue associated with a principal component $CP(b_i)$ is higher than that associated with a residual component $A(b_i)$. Consequently, the energy of a residual component $A(b_i)$ is lower than the energy of a principal component $CP(b_i)$.

Thus, the encoder 9 comprises frequency analysis means 31 designed to form at least one energy parameter $E(b_i)$ from amongst a set of energy parameters $E(b_1), \ldots, E(b_N)$ as a function of the residual frequency sub-components $A(b_1), \ldots, A(b_N)$ and/or principal frequency sub-components $CP(b_1), \ldots, CP(b_N)$.

According to a first embodiment, the energy parameters $E(b_1), \ldots, E(b_N)$ are formed by an extraction of the energy differences by frequency sub-bands between the principal frequency sub-components $CP(b_1), \ldots, CP(b_N)$ and the residual frequency sub-components $A(b_1), \ldots, A(b_N)$.

According to another embodiment, the energy parameters $E(b_1), \ldots, E(b_N)$ directly correspond to the energy by frequency sub-bands of the residual frequency sub-components $A(b_1), \ldots, A(b_N)$.

In addition, in order to compensate for a potential amplitude modification, the encoder 9 can comprise filtering means 32 in order to filter the principal frequency sub-components before the extraction of the energy parameters $E(b_1), \ldots, E(b_N)$.

Consequently, in order to better synthesize the background sound, the coded audio signal SC can advantageously comprise at least one energy parameter from amongst the set of energy parameters $E(b_1), \ldots, E(b_N)$.

Furthermore, the encoder 9 can comprise correlation analysis means 33 for carrying out a time correlation analysis between the two channels L and R in order to determine an index or a corresponding correlation value c. Thus, the coded audio signal SC can advantageously comprise this correlation value c in order to indicate a possible presence of reverberation in the original signal.

The definition means 29 can comprise an audio coding means 29*a* for coding the principal component CP and quantification means 29*b*, 29*c*, 29*d* for quantifying the transformation parameter or parameters and the energy parameter or parameters E.

Optionally, in the case of the coding of more than two channels, it is possible to code the at least two resulting principal components with a stereo coding means or other.

Figure 4:
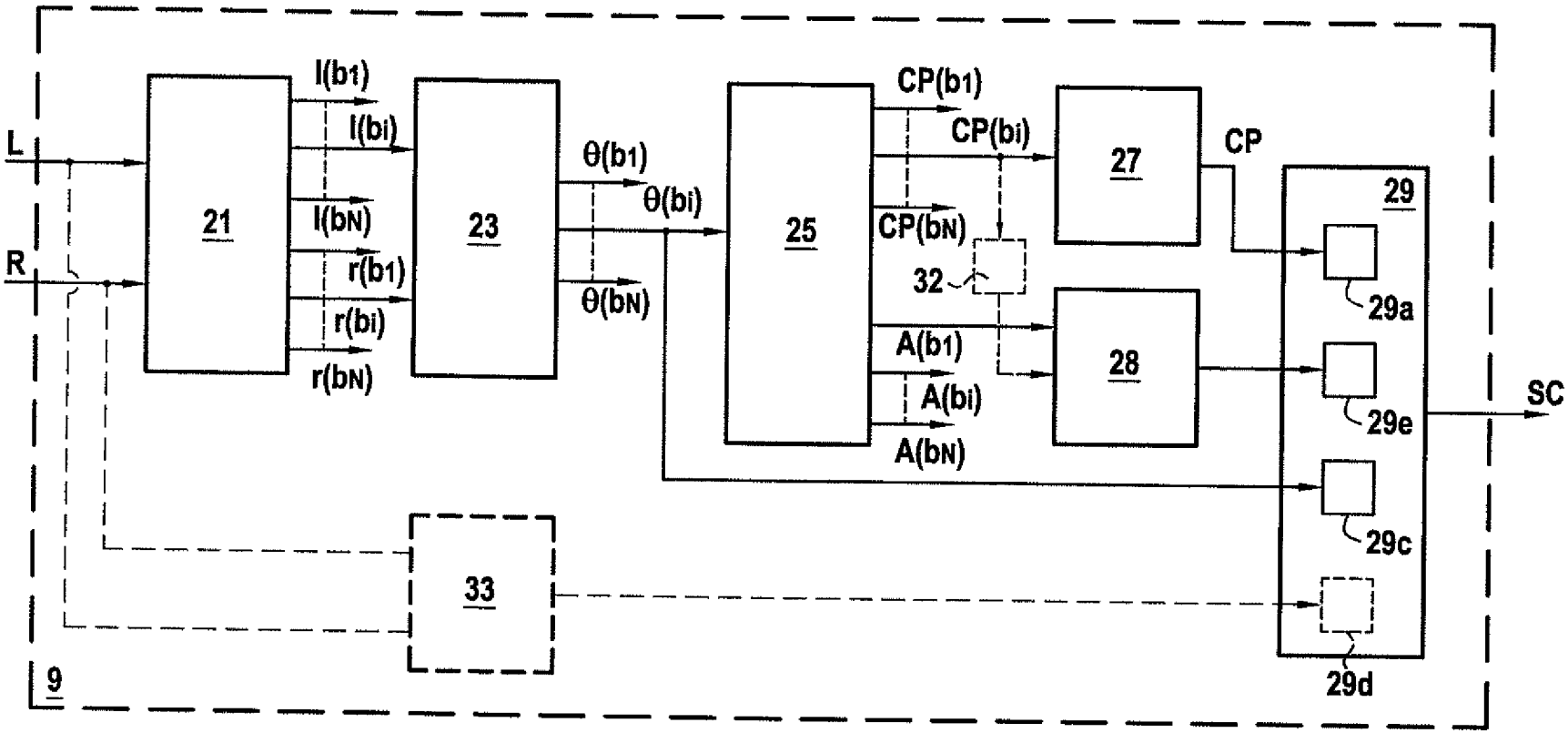

FIG. 4 is one variant showing an encoder 9 which differs from that in FIG. 3 solely by the fact that the frequency analysis means 31 are replaced by other combination means 28 allowing at least some of the residual frequency sub-components to be combined in order to form at least one residual component A. Thus, in this case, the coded audio signal also comprises this residual component A quantified by quantification means 29*e*.

Figure 5:
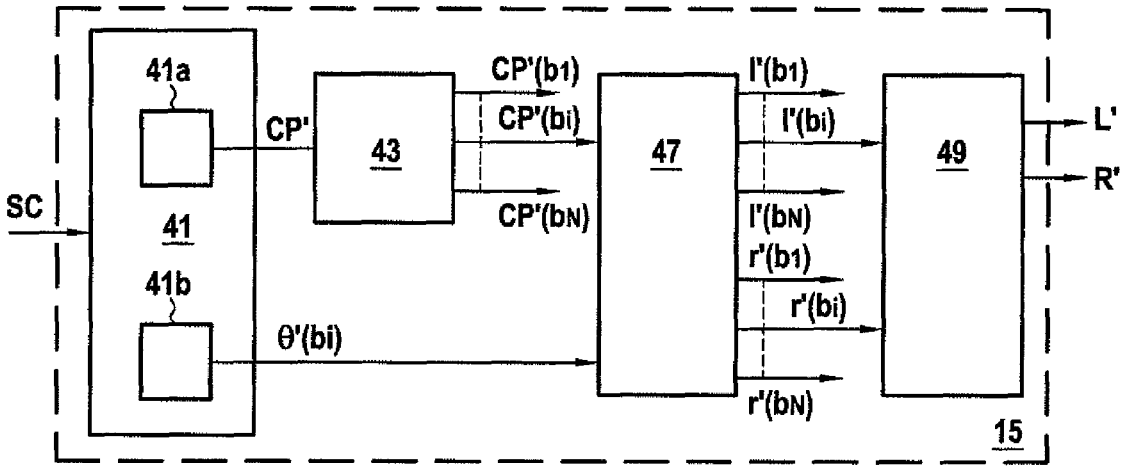
FIG. 5 is a schematic view of a decoder according to an embodiment of the invention.

FIG. 5 is a schematic view of a decoder 15 comprising extraction means 41, decoding decomposition means 43, inverse transformation means 47, and decoding combination means 49.

FIG. 5 also illustrates the main steps of the decoding method according to the invention.

Thus, when the decoder 15 receives a coded audio signal SC, the extraction means 41 then carry out the extraction of a decoded principal component CP' by audio decoding means 41*a* and at least one decoded transformation parameter $\theta(b_i)$ by dequantification means 41*b*.

The decoding decomposition means 43 are designed to decompose the decoded principal component CP' into decoded principal frequency sub-components $CP'(b_1), \ldots, CP'(b_N)$.

The inverse transformation means 47 are designed to transform the decoded principal frequency sub-components $CP'(b_1), \ldots, CP'(b_N)$ into a plurality of decoded frequency sub-bands $I'(b_1), \ldots, I'(b_N)$ and $r'(b_1), \ldots, r'(b_N)$.

Finally, the decoding combination means 49 are designed to combine the decoded frequency sub-bands in order to form at least two decoded channels L' and R' corresponding to the two channels L and R coming from the original multi-channel audio signal.

Figure 6:
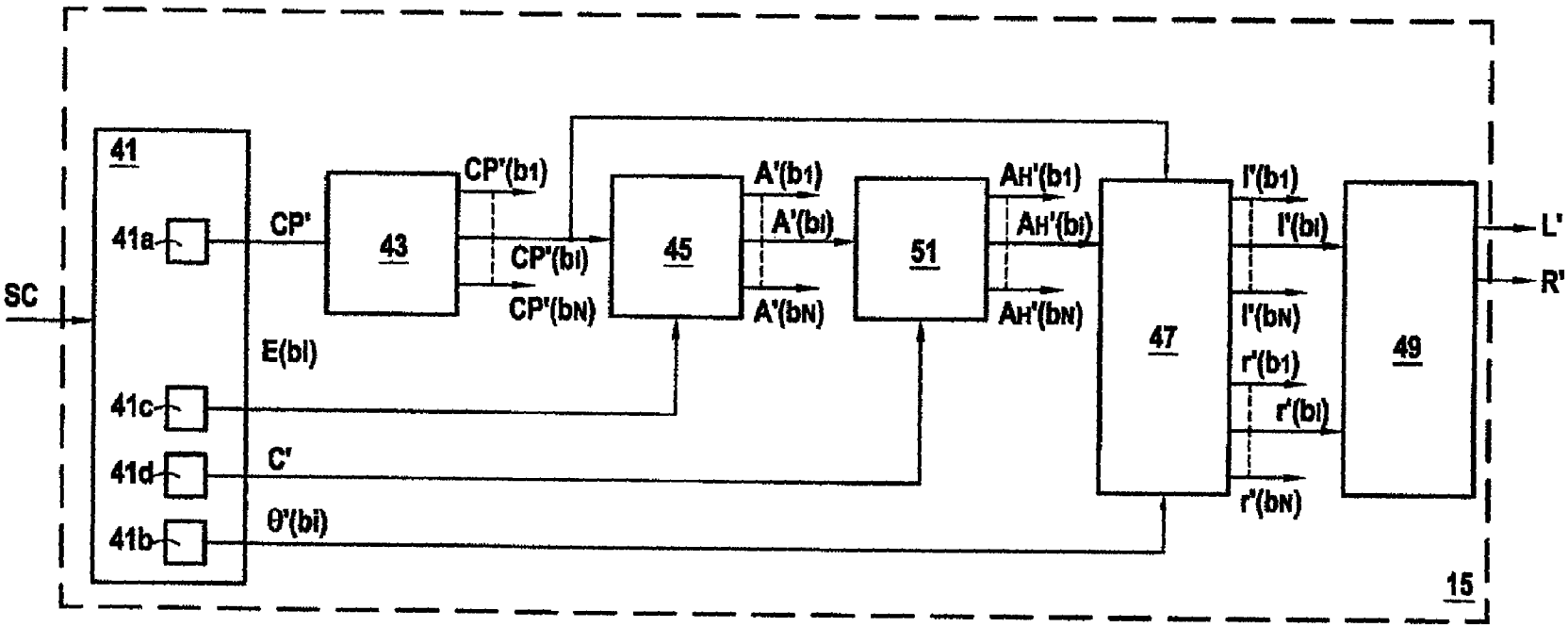
FIG. 6 is one variant of FIG. 5.

FIG. 6 is one variant showing a decoder 15 which differs from that in FIG. 5 solely by the fact that it comprises other dequantification means 41*c* and 41*d* in addition to 41*b*, frequency synthesis means 45 and filtering means 51.

Thus, the dequantification means 41*c* carry out an inverse quantification of at least one energy parameter $E(b_i)$ included in the coded audio signal SC and the frequency synthesis means 45 perform the synthesis of the decoded residual frequency sub-components $A'(b_1), \ldots, A'(b_N)$.

In addition, the dequantification means 41*d* carry out an inverse quantification of the correlation value c included in the coded audio signal and the filtering means 51 perform a decorrelation of the decoded residual frequency sub-components $A'(b_1), \ldots, A'(b_N)$ in order to form decorrelated residual sub-components $A_H'(b_1), \ldots, A_H'(b_N)$.

The filtering means 51 carry out the decorrelation according to a decorrelation or reverberation filtering as a function of the correlation value c.

FIGS. 7 to 15 illustrate schematically particular embodiments of the present invention.

Figure 7:
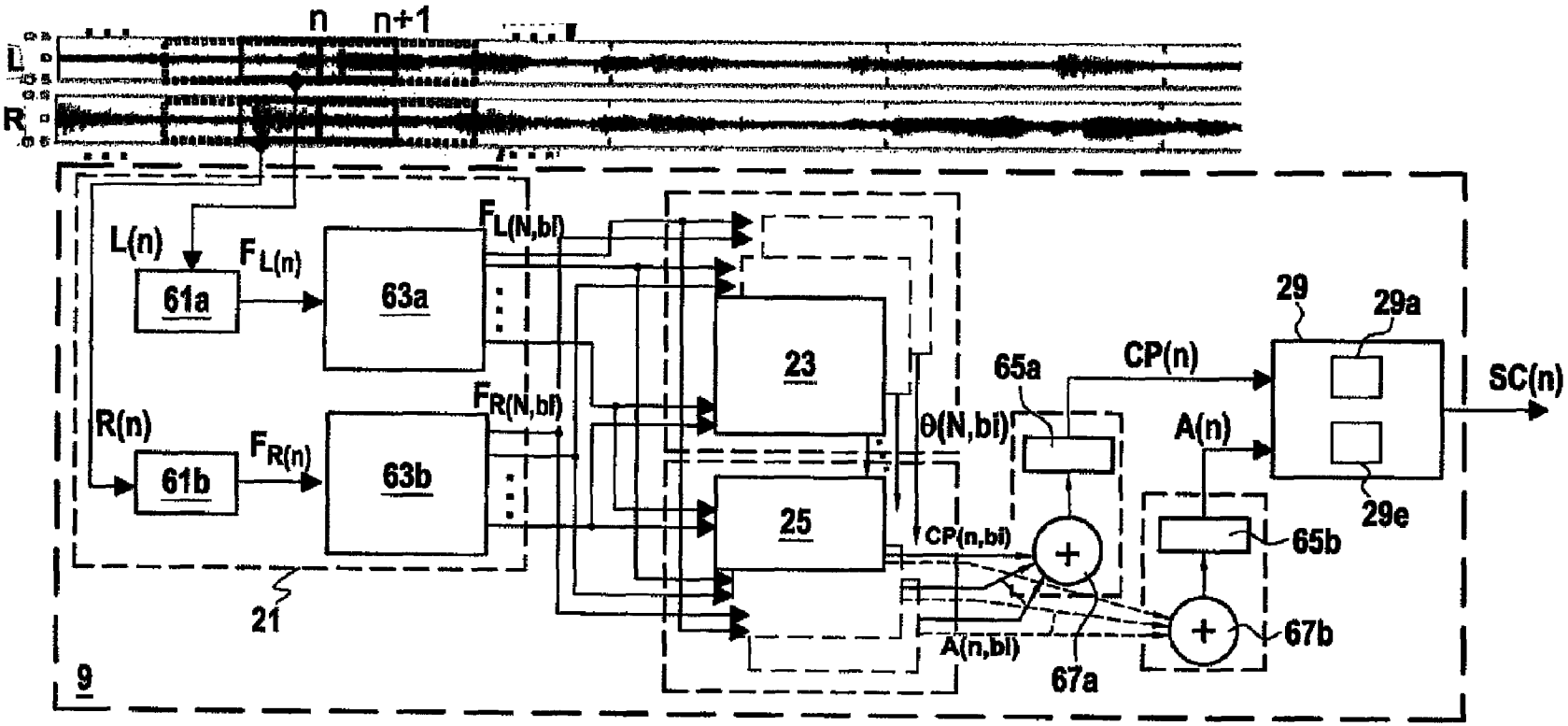
FIGS. 7 to 15 are schematic views of the encoders and decoders according to the particular embodiments of the invention.

FIG. 7 illustrates an encoder 9 for coding a stereophonic signal according to the PCA by frequency sub-bands. The stereophonic signal is defined by a succession of frames n, n+1, etc. and comprises two channels: a Left channel denoted L and a Right channel denoted R.

Thus, for a given frame n, the decomposition means 21 decompose the two channels L(n) and R(n) into a plurality of frequency sub-bands $F_L(n,b_1), \ldots, F_L(n,b_N), F_R(n,b_1), \ldots, F_R(n,b_N)$.

Indeed, the decomposition means 21 comprise short-term Fourier transform (STFT) means 61*a* and 61*b* and frequency windowing modules 63*a* and 63*b* allowing the coefficients of the short-term Fourier transform to be grouped into sub-bands.

Thus, a short-term Fourier transform is applied to each of the input channels L(n) and R(n). These channels expressed in the frequency domain are then windowed in frequency, by the windowing modules 63*a* and 63*b*, according to N bands defined according to a perceptual scale equivalent to the critical bands.

The covariance matrix can then be calculated by the calculation means 23 for each signal frame n analyzed and for each frequency sub-band $b_i$. The eigenvalues $\lambda_1(n, b_i)$ and $\lambda_2(n, b_i)$ of the stereophonic signal are then estimated for each frame n and each sub-band $b_i$, allowing the transformation parameter or rotation angle $\theta(n,b_i)$ to be calculated.

This angle of rotation $\theta(n,b_i)$ corresponds to the position of the dominant source at the frame n, for the sub-band $b_i$, and then allows the rotation or transformation means 25 to perform a rotation of the data by frequency sub-band in order to determine a principal frequency component $CP(n, b_i)$ and a residual (or background sound) frequency component $A(n, b_i)$. The energies of the components $CP(n, b_i)$ and $A(n, b_i)$ are proportional to the eigenvalues $\lambda_1$ and $\lambda_2$ such that: $\lambda_1 > \lambda_2$. Consequently, the signal A(b) has an energy much lower than that of the signal CP(b).

The combination means 27 combine the principal frequency sub-components $CP(n, b_1), \ldots, CP(n, b_N)$ in order to form one single principal component CP(n).

Indeed, these combination means 27 comprise inverse STFR means 65*a* and addition means 67*a*. The sum using the addition means 67*a* of these limited-band frequency components $CP(n, b_i)$ then allows the full-band principal component CP(n) in the frequency domain to be obtained. The inverse STFT of the component CP(n) produces a full-band time component.

The encoder 9 according to this example comprises other combination means 28 also comprising other inverse STFR means 65*b* and other addition means 67*b* allowing the inverse STFR of the sum of the components $A(n, b_i)$ to be carried out.

It will be noted that the principal component CP(n) contains the sum of the dominant sound sources and the part of the background sound components that spatially coincide with these dominant sources present in the original signals. The residual component A(n) corresponds to the sum of the secondary sound sources, which overlap spectrally with the dominant sources, and of the other background sound components.

Finally, the definition means 29 define an audio stream or a coded audio signal SC(n) representing the stereophonic audio signal. According to this example, the definition means 29 comprise monophonic audio coding means 29*a* for coding the principal component CP(n), means for audio coding 29*e* of the residual component A(n) and means for quantifying the transformation parameters (not shown).

The encoding of the stereophonic signal then consists in coding the signal CP(n) using a conventional monophonic audio coder 29*a* (for example the MPEG-1 Layer III or Advanced Audio Coding coder), in quantifying the rotation angles $\theta(n, b_i)$ calculated for each sub-band and in carrying out a parametric coding of the signal A(n).

Figure 8:
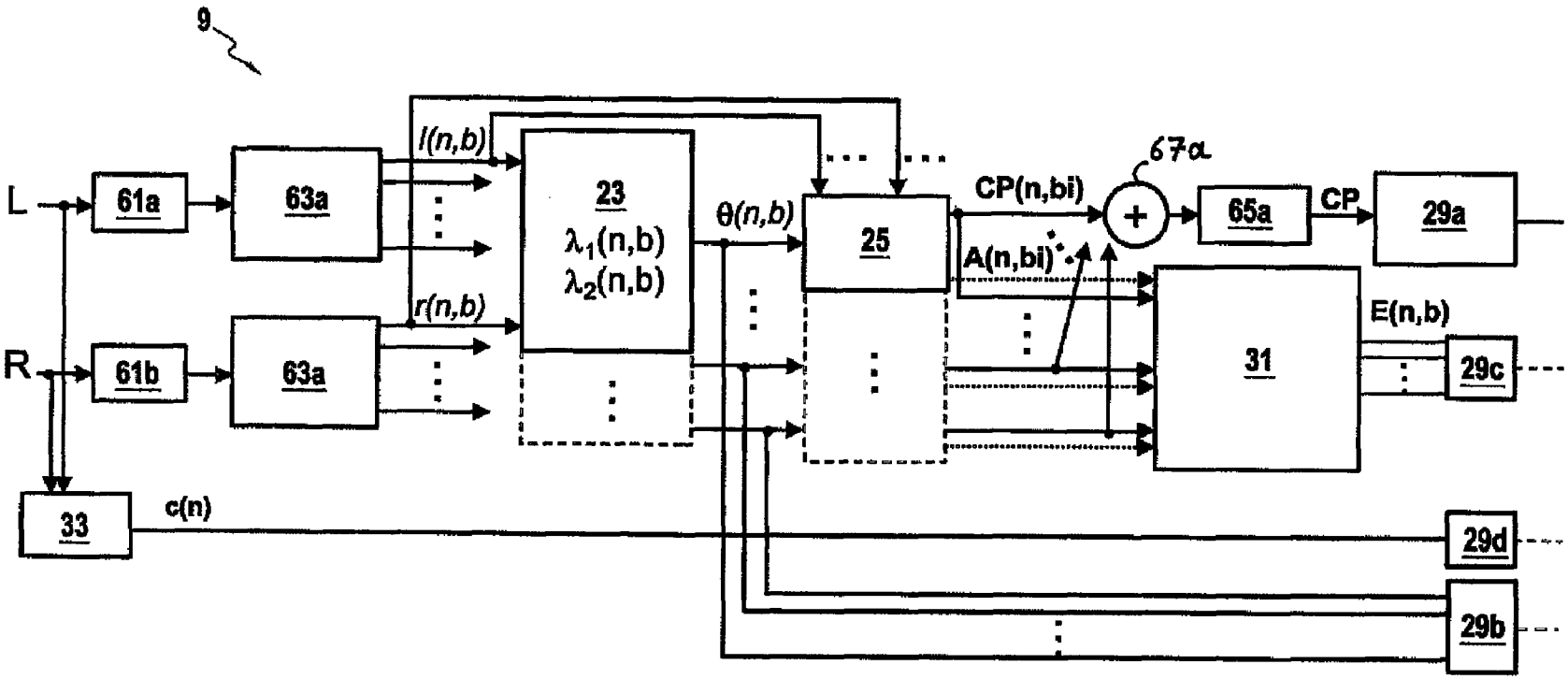

FIG. 8 illustrates one variant which differs from FIG. 7 by the fact that the other combination means 28 are replaced by frequency analysis means 31 which carry out a parametric coding of the residual frequency components $A(n, b_i)$.

This parametric coding consists in extracting the energy differences by frequency sub-band $E(n,b_i)$ between the signal $A(n, b_i)$ and the signal $CP(n, b_i)$.

Indeed, the object of the parametric coding is to be able to synthesize at the decoding (see FIG. 9) residual components $A'(n, b_i)$ based on the signal CP'(n) decoded by a monophonic audio decoder 41*a*, and energy parameters $E(n,b_i)$ quantified and transmitted by the encoder 9.

In addition, the encoder 9 according to this example comprises correlation analysis means 33 for determining a correlation value c(n) of the original signal at the frame n.

Finally, the principal component or signal CP(n) is coded as before by a monophonic audio coder 29*a*. Furthermore, the energy parameters $E(n,b_i)$, the rotation angles $\theta(n,b_i)$ for each sub-band and the correlation value c(n) are quantified by the quantification means 29*c*, 29*b* and 29*d*, respectively, and are transmitted to the decoder 15 so as to carry out the inverse PCA.

Figure 9:
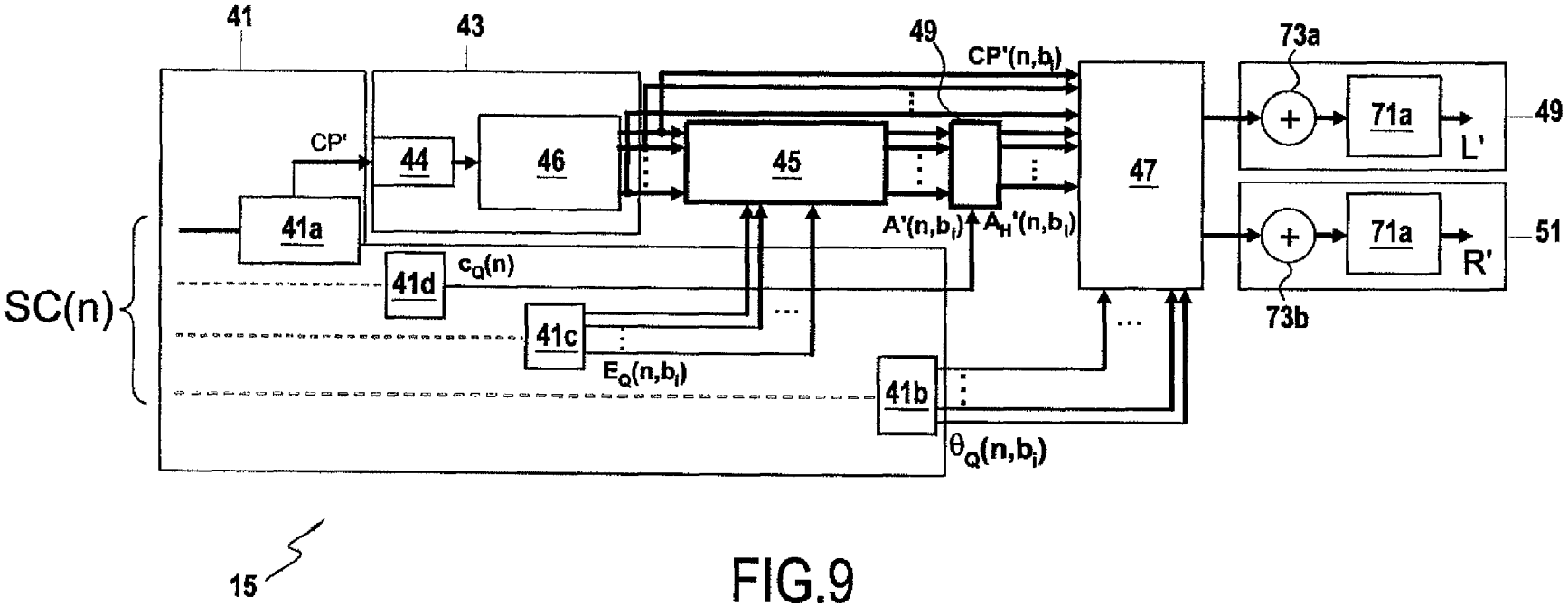

FIG. 9 is a schematic view of a decoder 15 for decoding a coded audio signal SC(n) comprising an audio stream and parameters for decoding into a stereophonic signal based on an inverse PCA by frequency sub-bands.

Thus, upon receiving the coded audio signal SC(n), the decoder 15 comprises monophonic decoding means 41*a* for extracting a decoded principal component CP'(n) and dequantification means 41*b*, 41*c* and 41*d* for extracting the transformation parameters or rotation angles $\theta_Q(n,b_i)$, the energy parameters $E_Q(n,b_i)$, and the correlation value $c_Q(n)$.

The decoding decomposition means 43 decompose the decoded principal component CP'(n), using a frequency windowing with N bands, into decoded principal frequency sub-components.

Furthermore, a residual component $A'(n, b_i)$ can be synthesized by frequency synthesis means 45 from the decoded audio stream $CP'(n,b_i)$, spectrally conditioned by the dequantified energy parameters $E_Q(n,b)$.

The decoder 15 then carries out the inverse operation to the coder since the PCA is a linear transformation. The inverse PCA is carried out by the inverse transformation means, by multiplying the signals $CP'(n,b_i)$ and $A'_H(n, b_i)$ by the transposed matrix of the rotation matrix used in the encoding. This is made possible thanks to the inverse quantification of the rotation angles by frequency sub-band.

It will be noted that the signals $A'_H(n, b_i)$ correspond to the residual components $A'(n, b_i)$ decorrelated by decorrelation or reverberation filtering means 49.

Indeed, because of the decorrelation proprieties of the PCA, the use of a decorrelation or reverberation filter is desirable in order to synthesize a decorrelated component $A'_H(n, b_i)$ of the signal $A'(n, b_i)$ and consequently of the signal $CP'(n, b_i)$.

The filtering means 49 comprise a filter whose pulse response h(n) is a function of the characteristics of the original signal. Indeed, the time analysis of the correlation of the original signal at the frame n determines the correlation value c(n) which corresponds to the choice of the filter to be used in the decoding. By default, c(n) imposes the pulse response of an all-pass filter with random phase which greatly reduces the inter-correlation of the signals $A'(n, b_i)$ and $A'_H(n, b_i)$. If the time analysis of the stereo signal reveals the presence of reverberation, c(n) imposes the use, for example, of a Gaussian white noise of decreasing energy in such a manner as to reverberate the content of the signal $A'(n, b_i)$.

Finally, combination means 49 and 51 comprising inverse STFT means 71*a* and 71*b* and addition means 73*a* and 73*b* combine the decoded frequency sub-bands in order to form two decoded components L'(n) and R'(n) corresponding to the two components L(n) and R(n) coming from the original stereophonic audio signal.

Figure 10:
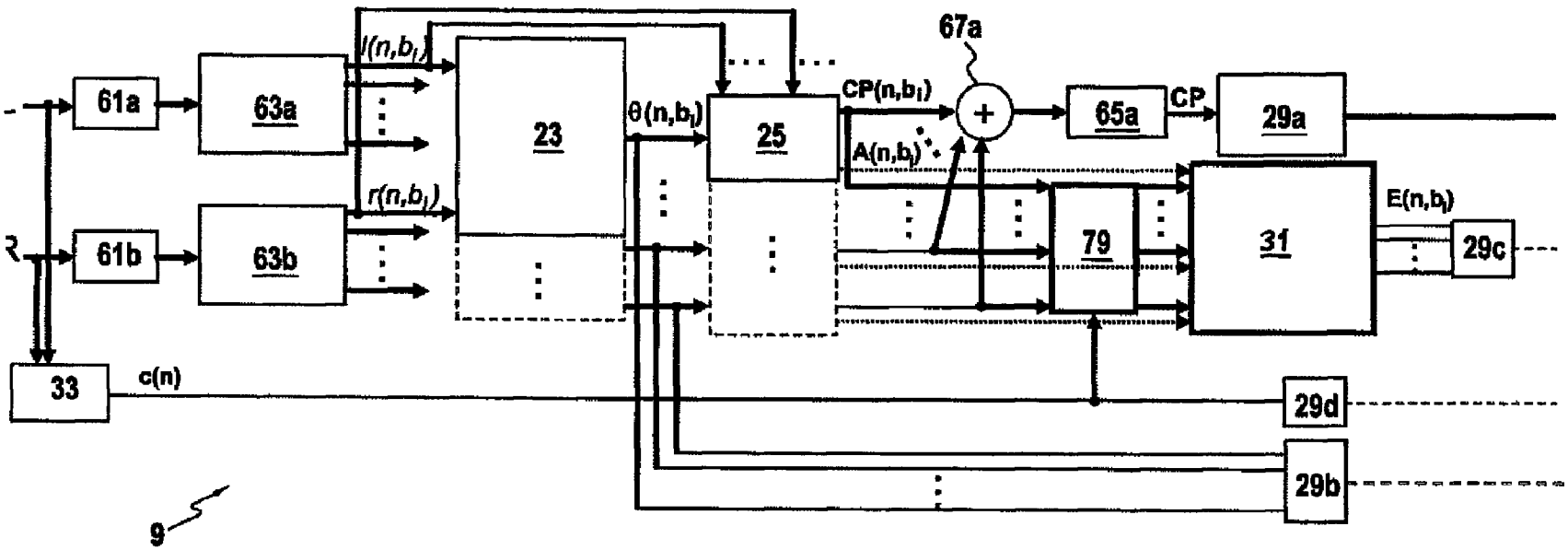
Figure 11:
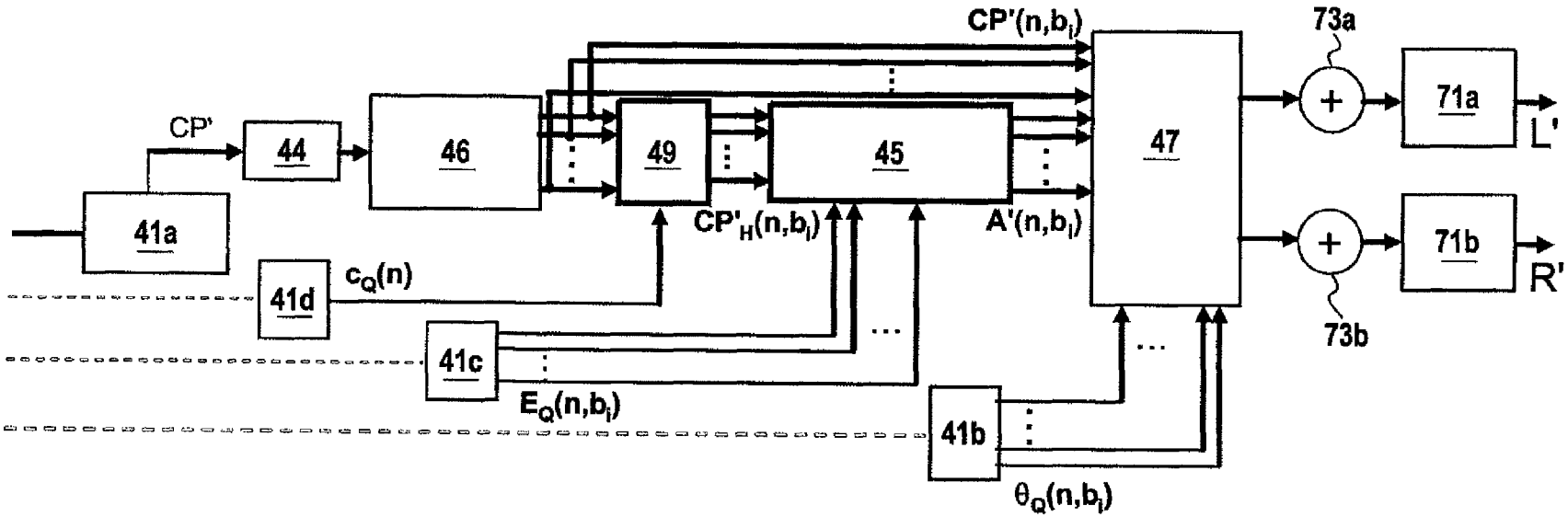

FIGS. 10 and 11 are variants of FIGS. 7 to 9, illustrating an encoder 9 and a corresponding decoder 15.

Indeed, one variant of the coding method described hereinbefore can be envisioned if the filtering modifies the amplitude of the filtered signal, which can notably be the case with a reverberation filter.

Thus, the encoder 9 in FIG. 10 comprises filtering means 79 for filtering the principal components $CP(n, b_i)$ forming filtered signals $CP_H(n, b_i)$.

In addition, the decoder 15 comprises filtering means 49 similar to those in FIG. 9.

In this case, the filtering is used in the decoding and in the encoding before estimating the energy parameters $E(n,b_i)$ between the signals $CP_H(n, b_i)$ and $A(n, b_i)$. The energy parameters $E(n,b_i)$ therefore characterize the energy differences by sub-band between the signals $CP_H(n, b_i)$ and $A(n, b_i)$.

In this way, at the decoding (see FIG. 11), a residual component $A'(n,b_i)$ can be synthesized from the filtering of the decoded signal $CP'_H(n, b_i)$ spectrally conditioned by the dequantified energy parameters $E_Q(n,b)$.

Furthermore, according to another variant, the transmitted energies $E_Q(n,b)$ can correspond to the energies by sub-band of the residual component $A(n,b_i)$ and are therefore applied to the decoded principal component in order to synthesize a background sound or residual signal A'(n) prior to the inverse PCA.

Figure 12:
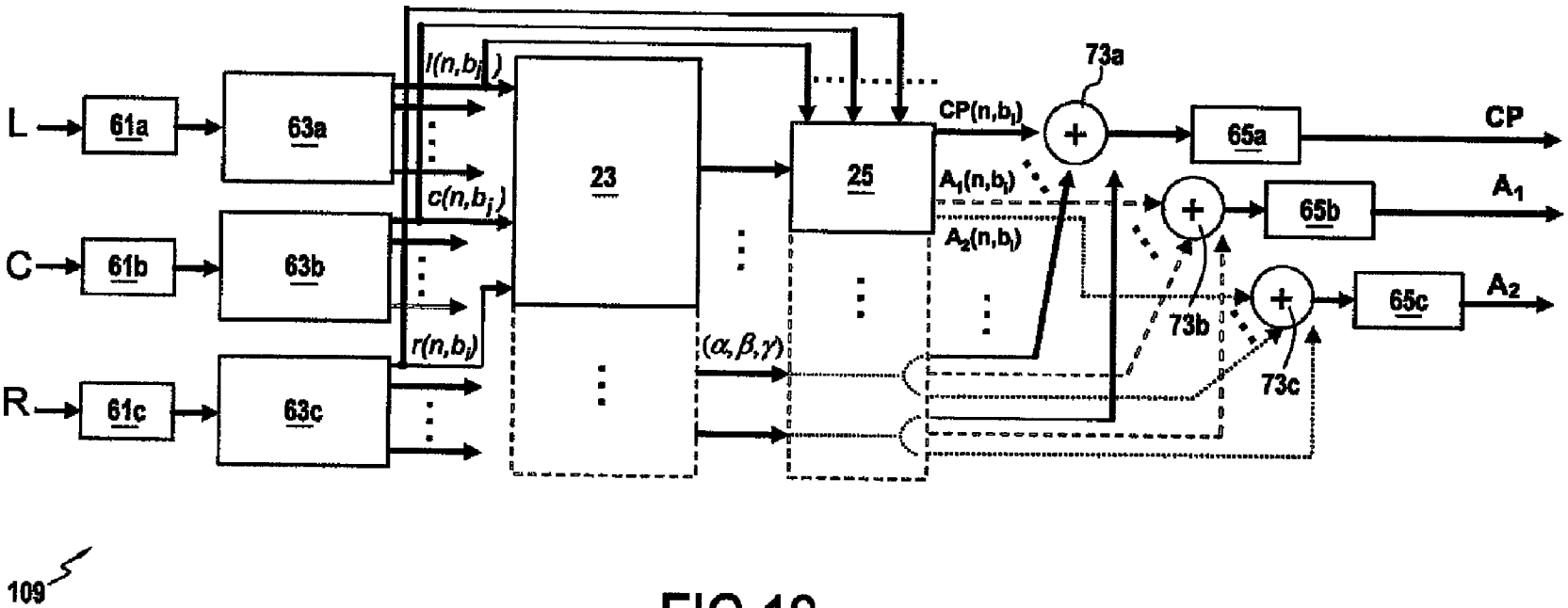

FIG. 12 illustrates an encoder 109 for a multi-channel signal applying the PCA to three channels. Indeed, this encoder uses a three-dimensional PCA of the signal with three channels whose parameters are set by the Euler angles $(\alpha,\beta,\gamma)_b$ estimated for each sub-band b.

The encoder 109 differs from that in FIG. 7 by the fact that it comprises three means of short-term Fourier transform (STFT) 61*a*, 61*b* and 61*c*, together with three frequency windowing modules 63*a*, 63*b* and 63*c*.

In addition, it comprises three inverse STFT means 65*a*, 65*b* and 65*c* together with three addition means 73*a*, 73*b* and 73*c*.

The PCA is then applied to a triplet of signals L, C and R. The 3D (three-dimensional) PCA is then carried out by a 3D rotation of the data whose parameters are set by the Euler angles $(\alpha,\beta,\gamma)$ As in the stereophonic case, these rotation angles are estimated for each frequency sub-band from the covariance and from the eigenvalues of the original multi-channel signal.

The signal CP contains the sum of the dominant sound sources and the part of the background sound components that spatially coincide with these sources present in the original signals.

The sum of the secondary sound sources, which spectrally overlap with the dominant sources, and of the other background sound components is distributed proportionately to the eigenvalues $\lambda_2$ and $\lambda_3$ in the signals $A_1$ and $A_2$ which are much less energetic than the signal CP since: $\lambda_1>\lambda_2>\lambda_3$.

Thus, the coding method applied to the stereophonic signals may be extended to the case of the multi-channel signals $C_1, \ldots, C_6$ in 5.1 format comprising the following channels: Left L, Center C, Right R, Left surround Ls, Right surround Rs, and Low Frequency Effect LFE.

Figure 13:
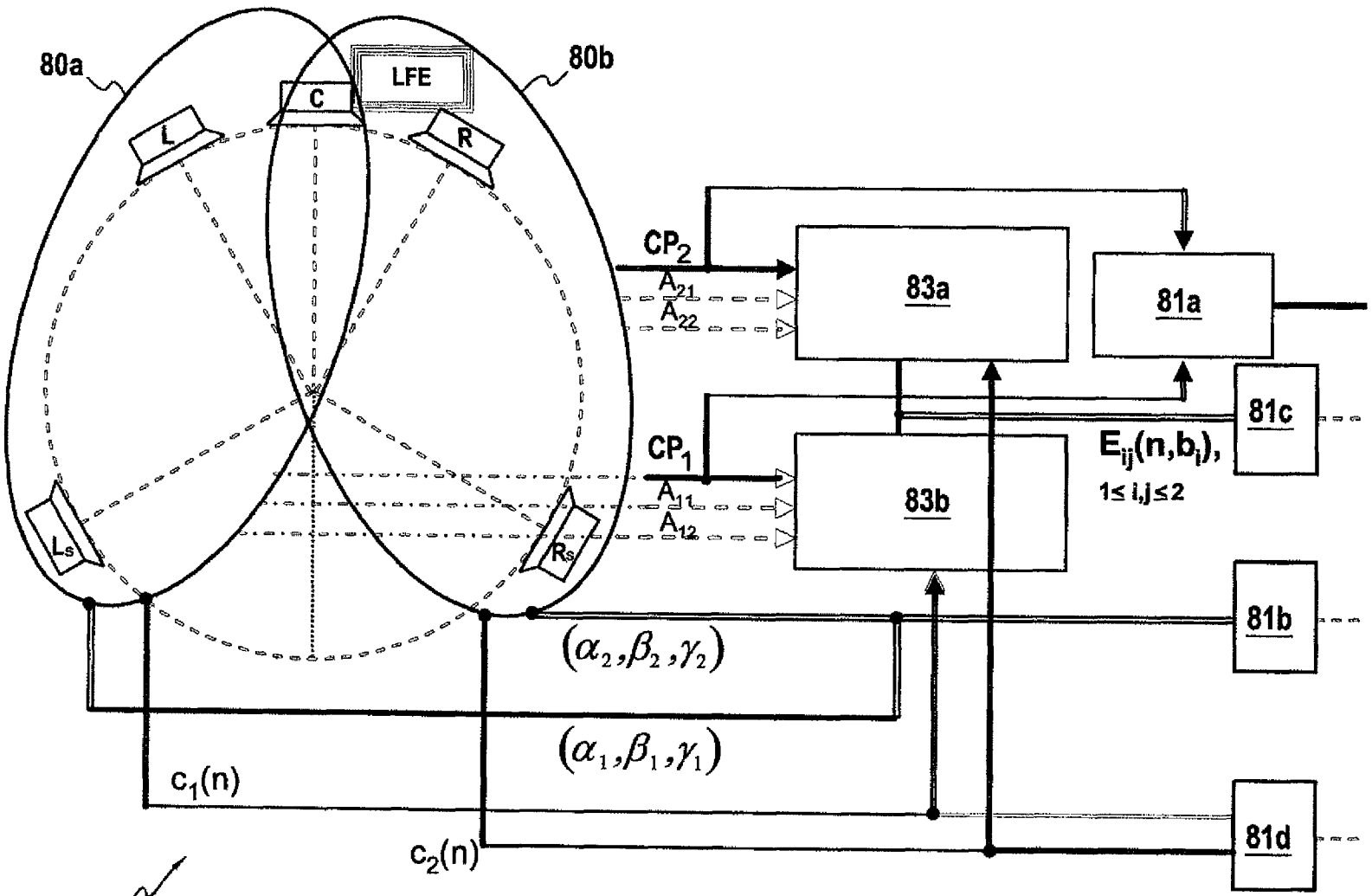

Indeed, FIG. 13 is a schematic view illustrating an encoder 209 of a multi-channel signal in 5.1 format. According to this example, the parametric audio coding of the 5.1 signals is based on two 3D PCAs of the signals separated along the mid-plane.

Thus, this encoder 209 allows a first $PCA_1$ of the triplet 80*a* of signals $(L, C, L_s)$ to be carried out according to the encoder 109 in FIG. 12 and, similarly, a second $PCA_2$ of the triplet 80*b* of signals $(R, C, R_s)$ to be carried out according to the encoder 109.

Thus, the pair of principal components $(CP_1, CP_2)$ may be considered as a stereophonic signal (L, R) spatially coherent with the original multi-channel signal.

It should be pointed out that the signal LFE can be coded independently of the other signals since the low-frequency content of this channel, of a discrete nature, is not that sensitive to the reduction of the inter-channel redundancies.

The encoding according to FIG. 13 can be adapted to the data rate limitations of the transmission network by transmitting a stereophonic signal coded by a stereophonic audio coder 81*a* accompanied by parameters quantified by quantification means 81*b*, 81*c* and 81*d* defined for each frame n and each frequency sub-band $b_i$.

Thus, the stereophonic audio coder 81*a* allows the pair of principal components $(CP_1, CP_2)$ to be coded. The quantification means 81*b* allow the Euler angles $(\alpha,\beta, \gamma)$, useful for the PCA of each triplet of signals, to be quantified.

The quantification means 81*d* allow the values $c_1(n)$ and $c_2(n)$, determining the choice of the filter to be used for each triplet of signals, to be quantified.

Furthermore, filtering and frequency analysis means 83*a* and 83*b* allow energy parameters or differences by frequency sub-band $E_{ij}(n,b)$ ($1 \leqq i,j \leqq 2$) between the signals $CP_1$ and $A_{11}$, $A_{12}$ and also the signals $CP_2$ and $A_{21}$, $A_{22}$, respectively, to be determined.

As a variant, the energy parameters correspond to the energies by sub-band of the signals $A_{11}$, $A_{12}$ and $A_{21}$, $A_{22}$.

Finally, the energy parameters $E_{ij}(n,b)$ can be quantified by the quantification means 81*c*.

Figure 14:
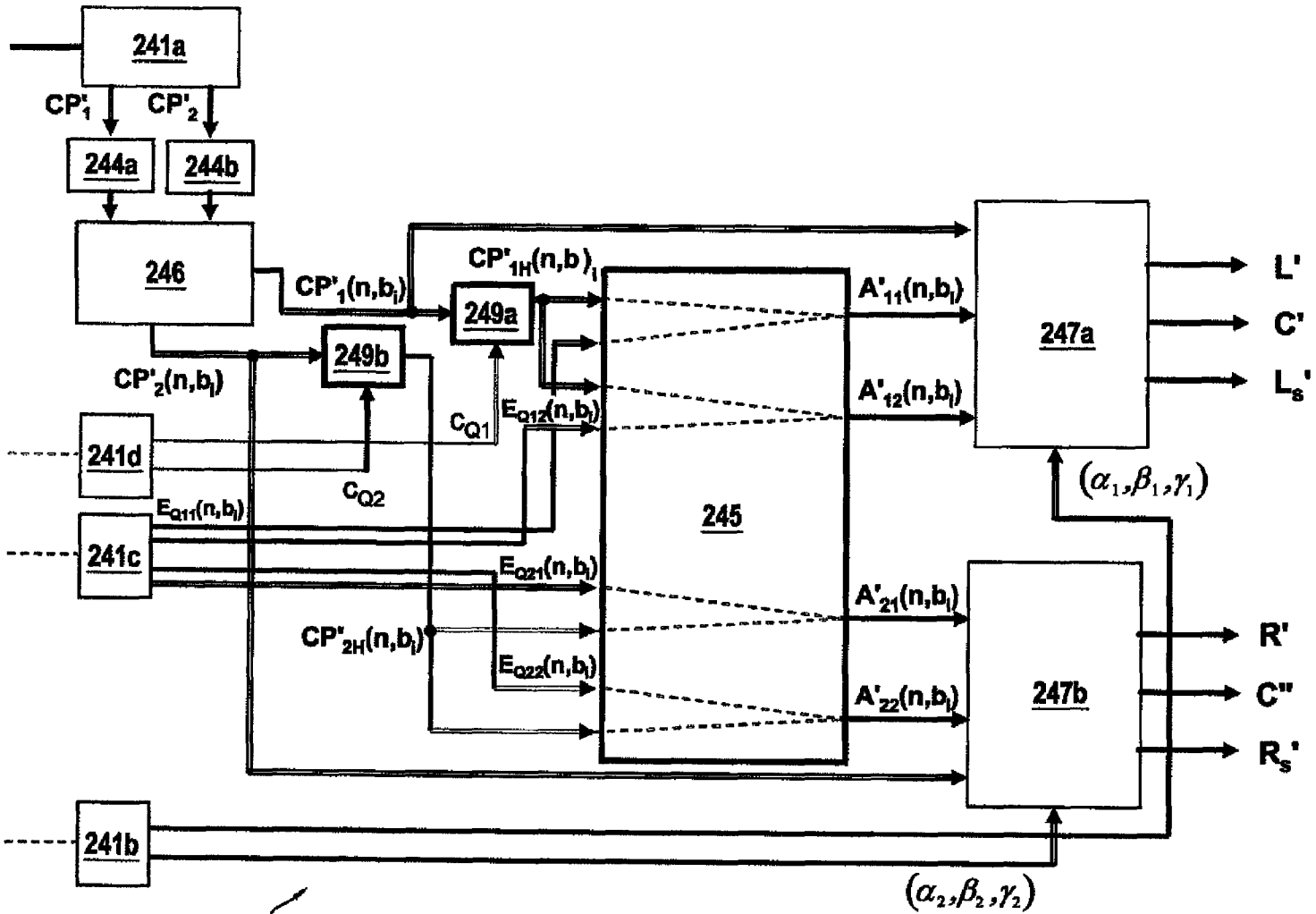

FIG. 14 illustrates a decoder 215 for a signal coded by the encoder 209 in FIG. 13.

This decoder 215 comprises means similar to the means of the decoder 15 in the preceding figures.

In addition, the decoder 215 comprises stereophonic decoding means 241*a* and dequantification means 241*b*, 241*c* and 24*d*.

They also comprise short-term Fourier transform (STFT) means 244*a* and 244*b* and frequency windowing modules 246.

In addition, the decoder 215 comprises filtering means 249*a* and 249*b*, frequency synthesis means 245 and inverse transformation means 247*a* ($PCA_1^{-1}$) and 247*b* ($PCA_2^{-1}$).

The decoding consists in processing the decoded principal components filtered by the filtering means 249*a* and 249*b* which can see their pulse response switch from an all-pass, random-phase filter to a reverberation filter whose pulse response can take the form of a white noise with decreasing envelope according to the correlation values $c_{Q1}$ and $C_{Q2}$.

Subsequently, the frequency synthesis means 245 carry out a synthesis in the frequency domain whose parameters are set by the energy differences, extracted at the encoding, between the components coming from the two $PCA_1$ and $PCA_2$ in 3D in FIG. 13 (or the energy of the background sound signals by sub-band).

Once the background sound components have been synthesized, the inverse 3D PCAs are carried out by the inverse transformation means 247*a* ($PCA_1^{-1}$) and 247*b* ($PCA_2^{-2}$) with the transposes of the 3D rotation matrices whose parameters are set by the dequantified Euler angles in order to form the pairs of signals (L', C', L's) and (R', C", R's).

It will be noted that the signals C' and C" can be summed so as to form a signal C"' given by $$C''' = \frac{C' + C''}{2}$$

in order to generate a center channel as near as possible to the original signal C. It is also possible to choose one of the two signals C' and C".

The signal LFE is then either decoded independently (by the filtering means 249*a*) or obtained by low-pass filtering (cut-off frequency at 120 Hz) of the decoded center channel C"' (by the filtering means 249*a*) or optionally by frequency synthesis starting from the decoded center signal C"' and energy parameters extracted at the encoding between the signal C and the signal LFE.

The coding technique thus described ensures compatibility of 5.1 sound systems with stereophonic sound systems since the decoded principal components ($CP'_1$ and $CP'_2$) form a stereophonic signal spatially coherent with the original 5.1 signal.

Compatibility with monophonic sound systems is also possible by carrying out a two-dimensional PCA (2D PCA) of the two principal components extracted at the encoding by the two 3D PCAs.

Figure 15:
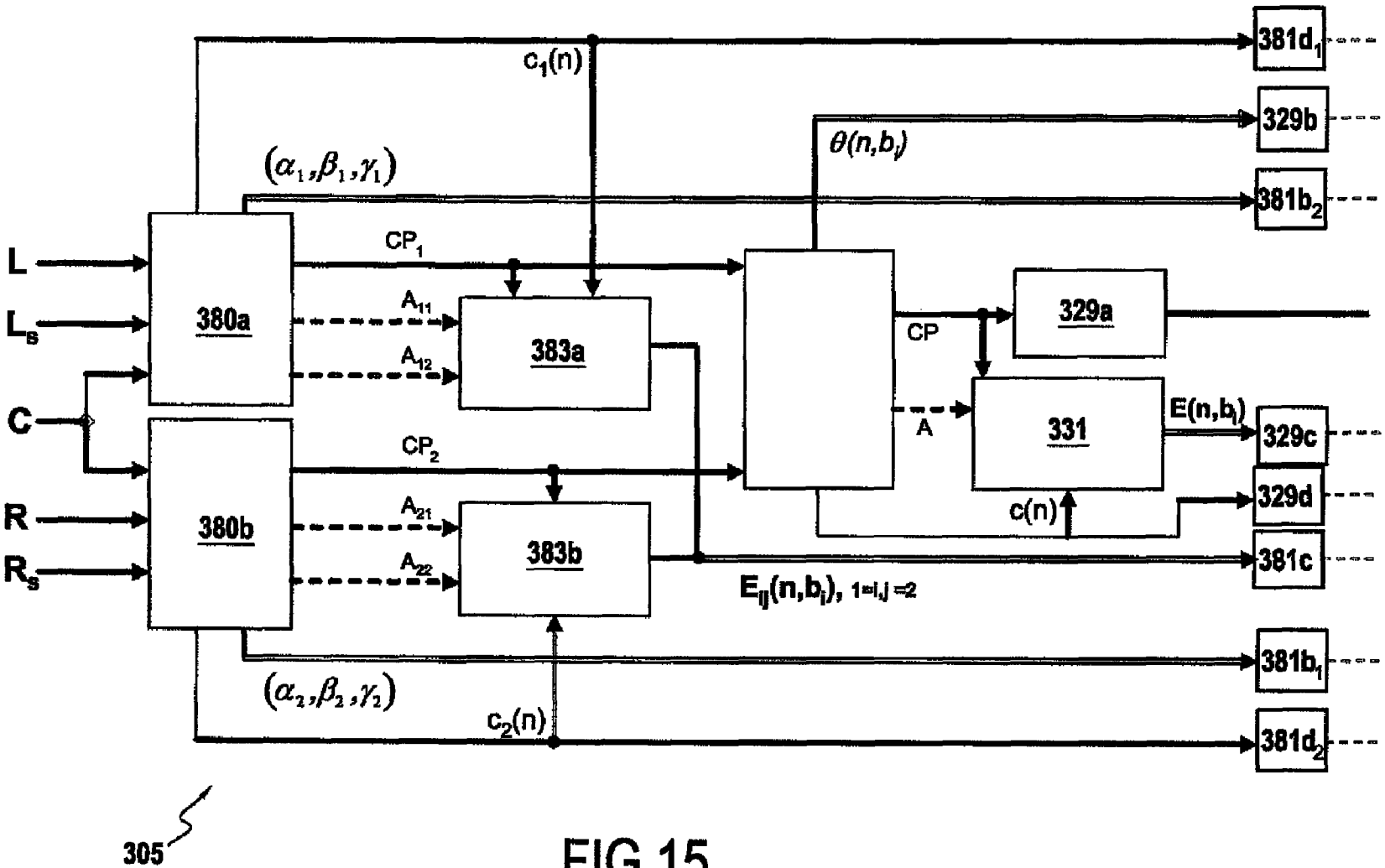

Indeed, FIG. 15 is a schematic view of an encoder 305 comprising two three-dimensional PCA means 380*a* ($PCA_1$) and 380*b* ($PCA_1$).

Thus, the encoder 305 carries out a parametric audio coding of the 5.1 signals based on the two three-dimensional PCA means 380*a* ($PCA_1$) and 380*b* ($PCA_1$) according to separate signals along the mid-plane.

This is followed by a two-dimensional PCA, by the two-dimensional PCA means, of the principal components of the original 5.1 signal.

Thus, the encoder 305 carries out the monophonic audio coding of the component CP by the monophonic coding means 329*a*.

Furthermore, filtering and frequency analysis means 383*a* and 383*b* allow energy parameters or differences $E_{ij}(n,b_i)$ ($1 \leqq i,j \leqq 2$), between the signals $CP_1$ and $A_{11}$, $A_{12}$ and also the signals $CP_2$ and $A_{21}$, $A_{22}$, respectively, to be determined for each frame n and each frequency sub-band $b_{ir}$. (As a variant, the energy parameters correspond to the energies by sub-band of the signals $A_{11}$, $A_{12}$ and $A_{21}$, $A_{22}$).

These energy parameters $E_{ij}(n,b)$ can be quantified by the quantification means 381*c*.

The quantification means 381*b*1 and 381*b*2 allow the Euler angles ($\alpha_1$, $\beta_1$, $\gamma_1$) and ($\alpha_2$, $\beta_2$, $\gamma_2$), useful for the PCA of each triplet of signals, to be quantified.

The quantification means 81*d*1, 81*d*2 and 329*d* allow the values $c_1(n)$, $c_2(n)$ and $c(n)$, respectively, determining the choice of the filter to be used in order to generate the background sound components decorrelated from the principal components, to be quantified.

The quantification means 329*b* allow the rotation angle, useful for the 2D PCA of the principal components coming from the transformation means 325 (2D PCA), to be quantified.

In addition, the energy differences $E(n, b_i)$, for each frame n and each frequency sub-band $b_1$ between the signals CP and A (or the energies by sub-band of the signal A) coming from the filtering and frequency analysis means 331 can be quantified by the quantification means 329*c*.

Thus, the associated decoder can directly decode the stream into a monophonic signal CP'. By using the appropriate dequantified parameters ($E_Q(n,b)$, $c_Q(n)$ and $\theta(n,b)$), the decoder can generate a background sound component A' and carry out the inverse 2D PCA. Subsequently, the decoder can deliver the stereophonic signal $CP'_1$, $CP'_2$. In the same way, by using the appropriate dequantified parameters ($E_{ijQ}(n,b)$ for $1 \leqq i,j \leqq 2$, $c_{1Q}Q(n)$, $c_{2Q}(n)$, $(\alpha_1,\beta_1,\gamma_1)_{(n,b)}$ and $(\alpha_2,\beta_2,\gamma_2)_{(n,b)}$, the decoder can synthesize the background sound components required to perform the two inverse 3D PCAs and to thus reconstruct the 5.1 signal.

The method for coding audio signals of the 5.1 type proposed is based on a separation of the signals along the mid-plane (vertical plane that separates the left and the right of the listener) which enables the 3D PCAs of the two triplets of signals (L, C, Ls) and (R, C, Rs). It should be pointed out that a separation front/rear of the signals may also be envisioned. In this case, a 3D PCA of the triplet of signals (L, C, R: frontal scene) and a 2D PCA of the pair of signals (Ls, Rs: rear scene) can be employed. The technique for coding the signals coming from these PCAs then follows the same principle as that previously described. Nevertheless, in this case, the compatibility with stereophonic sound systems may be lost.

A multitude of configurations may be envisioned based on the association of the 2D PCA and/or 3D PCA modules. The example in FIG. 15 represents only one of these numerous possible configurations.

Indeed, the coding of the audio signals of the 5.1 type may, for example, be carried out with three 2D PCAs of the pairs (L, Ls), (C, LFE), (R, Rs) followed by a 3D PCA of the three resulting principal components ($CP_1$, $CP_2$, $CP_3$).

Figure 16:
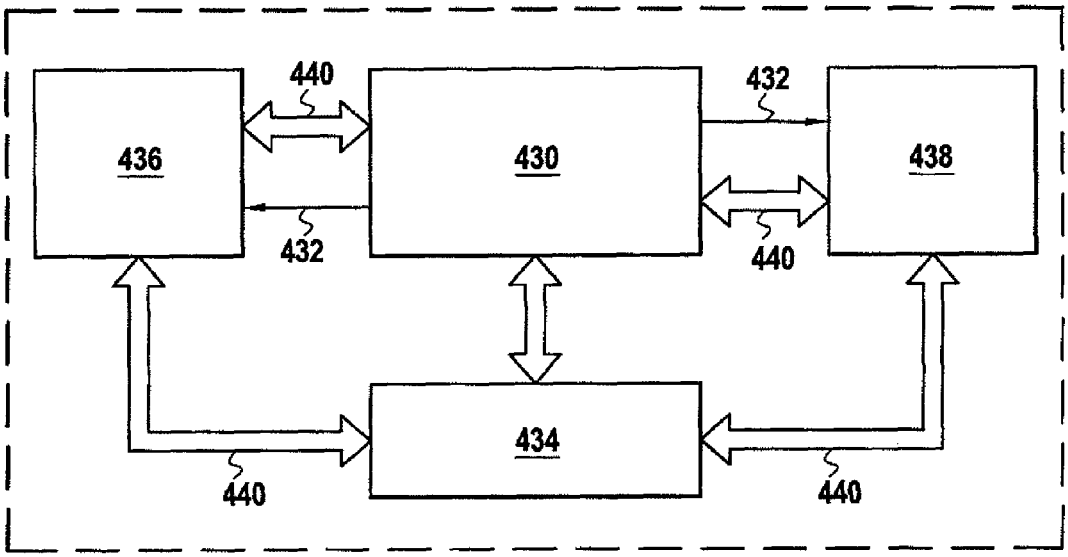
FIG. 16 is a schematic view of a computer system implementing the encoder and the decoder according to FIGS. 1 to 15.

FIG. 16 illustrates very schematically a computer system implementing the encoder or the decoder according to FIGS. 1 to 15. This computerized system conventionally comprises a central processing unit 430 controlling, via signals 432, a memory 434, an input unit 436 and an output unit 438. All the elements are connected together via data buses 440.

Moreover, this computerized system can be used to execute a computer program comprising program code instructions for the implementation of the coding or decoding method according to the invention.

Indeed, another aim of the invention is to provide a computer program product downloadable from a communications network comprising program code instructions for the execution of the steps of the coding or decoding method according to the invention when it is executed on a computer. This computer program can be stored on a medium readable by a computer and can be executable by a microprocessor.

This program may use any programming language, and may be in the form of source code, object code, or of code intermediate between source code and object code, such as in a partially compiled form, or in any other form that may be desired.

Another aim of the invention is to provide an information medium readable by a computer and comprising instructions for a computer program such as mentioned hereinabove.

The information medium may be any entity or device capable of storing the program. For example, the medium can comprise a storage means, such as an ROM, for example a CD ROM or a microelectronic circuit ROM, or alternatively a magnetic recording means, for example a floppy disk or a hard disk.

Furthermore, the information medium may be a transmissible medium such as an electrical or optical signal, which can be carried via an electrical or optical cable, by radio or by other means. The program according to the invention may, in particular, be uploaded to and downloaded from a network of the Internet type.

Alternatively, the information medium may be an integrated circuit into which the program is incorporated, the circuit being designed to execute or to be used in the execution of the method in question.

Thus, the PCA carried out by frequency sub-bands according to the invention allows the energy of the original components to be further compacted compared with a PCA carried out in the time domain. The energy of the background sound component A (respectively, CP) is lower (respectively, higher) with a PCA carried out by frequency sub-bands.

Furthermore, the method can be extended to the coding of various types of multi-channel audio signals (2D and 3D audio formats).

In addition, the coding method according to the invention is scalable in number of decoded channels. For example, the coding of a signal in the 5.1 format also allows its decoding into a stereophonic signal so as to ensure the compatibility with various reproduction systems.

The fields of application of the present invention are audio-digital transmissions over various transmission networks at various data rates since the method proposed allows the coding rate to be adapted according to the network or the quality desired.

In addition, this method may be generalized to multi-channel audio coding with a larger number of signals. Indeed, the method proposed is, by its nature, generalizable and applicable to numerous audio 2D and 3D formats (formats 6.1, 7.1, ambisonic, wave-field synthesis, etc.).

One particular example of application is the compression, transmission then reproduction of a multi-channel audio signal over the Internet following the request/purchase by a user (listener). This service is furthermore commonly referred to as "audio-on-demand". The method proposed then allows a multi-channel signal (stereophonic or of the 5.1 type) to be encoded at a data rate supported by the Internet network connecting the listener to the server. Thus, the listener can listen to the sound scene, decoded in the desired format, on his multi-channel sound system. In the case where the signal to be transmitted is of the 5.1 type, but the user does not possess a multi-channel reproduction system, the transmission may then be limited to the principal components of the initial multi-channel signal; subsequently, the decoder delivers a signal with less channels, such as a stereophonic signal for example.

The invention claimed is:

1. A method for coding by principal component analysis (PCA) of a multi-channel audio signal ($C_1, \ldots, C_M$), comprising the steps of:

decomposing at least two channels (L, R) of said audio signal into a plurality of frequency sub-bands ($I(b_1), \ldots I(b_N)$, $r(b_1), \ldots r(b_N)$):

calculating a rotation angle ($\theta(b_1), \ldots \theta(b_N)$) per sub-band among at least some of said plurality of frequency sub-bands, as at least one transformation parameter;

transforming at least some of said plurality of frequency sub-bands into a plurality of frequency sub-components using at least one of the calculated rotation angles ($\theta(b_1), \ldots \theta(b_N)$), as the at least one transformation parameter, said plurality of frequency sub-components comprising principal frequency sub-components ($CP(b_1), \ldots CP(b_N)$);

combining at least some of said principal frequency sub-components ($CP(b_1), \ldots CP(b_N)$) in order to form a principal component (CP); and forming a coded audio signal (SC) representing said multi-channel audio signal ($C_1, \ldots C_M$), said coded audio signal (SC) comprising said principal component (CP) and said at least one transformation parameter ($\theta(b_1), \ldots \theta(b_N)$).

2. The method as claimed in claim 1, wherein said plurality of frequency sub-components also comprises residual frequency sub-components ($A(b_1), \ldots A(b_N)$).

3. The method as claimed in claim 2, comprising the formation of a set of energy parameters ($E(b_1), \ldots E(b_N)$) as a function of the residual frequency sub-components ($A(b_1), \ldots A(b_N)$).

4. The method as claimed in claim 3, wherein the set of energy parameters ($E(b_1), \ldots E(b_N)$) is formed by extraction of the energy differences by frequency sub-bands between the principal frequency sub-components ($CP(b_1), \ldots CP(b_N)$) and the residual frequency sub-components ($A(b_1), \ldots A(b_N)$).

5. The method as claimed in claim 3, wherein the set of energy parameters ($E(b_1), \ldots E(b_N)$) corresponds to the energies of the residual frequency sub-components ($A(b_1), \ldots A(b_N)$).

6. The method as claimed in claim 3, comprising a filtering of the principal frequency sub-components before the extraction of the set of energy parameters ($E(b_1), \ldots, E(b_N)$).

7. The method as claimed in claim 3, wherein the coded audio signal (SC) also comprises at least one energy parameter from amongst said set of energy parameters ($E(b_1), \ldots, E(b_N)$).

8. The method as claimed in claim 7, wherein the definition of said coded audio signal comprises an audio coding of said principal component (CP) and a quantification of said at least one transformation parameter and/or a quantification of said at least one energy parameter E, and/or a quantification of said at least one residual component (A).

9. The method as claimed in claim 3, comprising a combination of at least some of said residual frequency sub-components in order to form at least one residual component (A) and in that the coded audio signal also comprises said at least one residual component (A).

10. The method as claimed in claim 1, comprising a correlation analysis between said at least two channels (L, R) in order to determine a corresponding correlation value (c), and in that said coded audio signal also comprises said correlation value (c).

11. The method as claimed in claim 1, wherein said plurality of frequency sub-bands ($I(b_1), \ldots, I(b_N), r(b_1), \ldots, r(b_N)$) is defined according to a perceptual scale.

12. The method as claimed in claim 1, wherein said audio signal is defined by a succession of frames such that said at least two channels (L, R) are defined for each frame n.

13. The method as claimed in claim 1, wherein the multi-channel audio signal ($C_1, \ldots, C_M$) is a stereophonic signal.

14. The method as claimed in claim 1, wherein the multi-channel audio signal ($C_1, \ldots, C_M$) is an audio signal in the 5.1 format comprising the following channels: Left (L), Center (C), Right (R), Left surround (Ls), Right surround (Rs), and Low Frequency Effect (LFE).

15. The method as claimed in claim 14, comprising the formation of a first triplet of signals comprising the Left, Center and Left surround (L, C, Ls) channels and of a second triplet of signals comprising the Right, Center, and Right surround (R, C, Rs) channels and in that the first and second triplets are used separately in order to form first and second principal components (CP1, CP2) depending on transformation parameters comprising first and second Euler angles, respectively.

16. A method for decoding a received signal comprising a coded audio signal constructed as claimed in claim 1, comprising the steps of:

receiving the coded audio signal (SC);

extracting a decoded principal component (CP') and at least one decoded transformation parameter;

decomposing said decoded principal component (CP') into decoded principal frequency sub-components;

transforming said decoded principal frequency sub-components into a plurality of decoded frequency sub-bands; and p1 combining the decoded frequency sub-bands in order to form at least two decoded channels (L', R') corresponding to said at least two channels (L, R) coming from said original multi-channel audio signal.

17. The decoding method as claimed in claim 16, comprising the inverse quantification of energy parameters included in the coded audio signal in order to synthesize decoded residual frequency sub-components.

18. The decoding method as claimed in claim 17, comprising a step for decorrelation of the decoded residual frequency sub-components in order to form decorrelated residual sub-components.

19. The decoding method as claimed in claim 18, wherein the decorrelation is carried out by a decorrelation or reverberation filtering according to a correlation value (c) included in the coded audio signal.

20. A computer program downloadable from a communications network and/or stored on a non-transitory medium readable by a computer and/or executable by a microprocessor, wherein the computer program comprises program code instructions for the execution of the steps of the decoding method as claimed in claim 16, when executed on a computer.

21. A computer program downloadable from a communications network and/or stored on a non-transitory medium readable by a computer and/or executable by a microprocessor, wherein the computer program comprises program code instructions for the execution of the steps of the encoding method as claimed in claim 1, when it is executed on a computer.

22. An encoder using principal component analysis (PCA) of a multi-channel audio signal ($C_1, \ldots, C_M$), said encoder comprising:

decomposition means for decomposing at least two channels (L, R) of said audio signal into a plurality of frequency sub-bands ($I(b_1), \ldots, I(b_N), r(b_1, \ldots r(b_N)$);

calculation means for calculating a rotation angle ($\theta(b_1), \ldots, \theta(b_N)$) per sub-band among at least some of said plurality of frequency sub-bands, as at least one transformation parameter;

transformation means for transforming at least some of said plurality of frequency sub-bands into a plurality of frequency sub-components using at least one of the calculated rotation angles ($\theta(b_1), \ldots, \theta(b_N)$ as the at least one transformation parameter, said plurality of frequency sub-components comprising principal frequency sub-components ($CP(b_1), \ldots, CP(b_N)$);

combination means for combining at least some of said principal frequency sub-components ($CP(b_1), \ldots, CP(b_N)$) in order to form a principal component (CP) ; and formation means for forming a coded audio signal (SC) representing said multi-channel audio signal ($C_1, \ldots, C_M$), said coded audio signal (SC) comprising said principal component (CP) and said at least one transformation parameter ($\theta(b_1), \ldots, (\theta(b_N)$).

23. A system comprising the encoder as claimed in claim 22 and decoder of a received signal comprising a coded audio signal (SC) coming from an original multi-channel signal comprising at least two channels (L, R), wherein said decoder comprises:

extraction means for extracting a decoded principal component (CP') and at least one decoded transformation parameter;

decoding decomposition means for decomposing said decoded principal component (CP') into decoded principal frequency sub-components;

inverse transformation means for transforming said decoded principal frequency sub-components ($CP'(b_1), \ldots, CP'(b_N)$) into a plurality of decoded frequency sub-bands ($I'(b_1), \ldots, I'(b_N)$); and decoding combination means for combining said decoded frequency sub-bands in order to form at least two decoded channels (L', R') corresponding to said at least two channels (L, R) coming from said original multi-channel audio signal.

24. A decoder of a received signal comprising a coded audio signal (SC) coming from an original multi-channel signal comprising at least two channels (L, R), wherein said decoder comprises:

extraction means for extracting a decoded principal component (CP') and at least one decoded transformation parameter;

decoding decomposition means for decomposing said decoded principal component (CP') into decoded principal frequency sub-components;

inverse transformation means for transforming said decoded principal frequency sub-components ($CP'(b_1), \ldots, CP'(b_N)$) into a plurality of decoded frequency sub-bands ($I'(b_1), \ldots, I'(b_N)$) ; and decoding combination means for combining said decoded frequency sub-bands in order to form at least two decoded channels (L', R') corresponding to said at least two channels (L, R) coming from said original multi-channel audio signal.

* * * * *